US009395093B2

(12) United States Patent
Yu et al.

(10) Patent No.: US 9,395,093 B2
(45) Date of Patent: Jul. 19, 2016

(54) RANGE HAVING AN ADJUSTABLE REAR PANEL

(71) Applicant: LG ELECTRONICS INC., Seoul (KR)

(72) Inventors: Seonil Yu, Seoul (KR); Sojin Park, Seoul (KR); Sooyeon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 171 days.

(21) Appl. No.: 14/107,054

(22) Filed: Dec. 16, 2013

(65) Prior Publication Data

US 2015/0007806 A1 Jan. 8, 2015

(30) Foreign Application Priority Data

Jul. 8, 2013 (KR) ..... 10-2013-0079455

(51) Int. Cl.

| | |
|---|---|
| ***F24C 15/36*** | (2006.01) |
| *F24C 15/28* | (2006.01) |
| *F24C 15/12* | (2006.01) |

(52) U.S. Cl.
CPC ..... *F24C 15/36* (2013.01); *F24C 15/12* (2013.01); *F24C 15/28* (2013.01)

(58) Field of Classification Search
CPC ..... F24C 15/36; F24C 15/12; F24C 15/2042; F24C 15/2085; F24C 15/2092; F24C 15/28
See application file for complete search history.

(56) References Cited

U.S. PATENT DOCUMENTS

2008/0029081 A1* 2/2008 Gagas ..... F24C 15/2035 126/299 D

* cited by examiner

*Primary Examiner* — Alfred Basichas
(74) *Attorney, Agent, or Firm* — KED & Associates, LLP

(57) ABSTRACT

Disclosed is a range that includes a main body, an oven provided in the main body, a cooktop provided over the oven, a rear panel provided over the main body adjacent the cooktop and configured to slidably extend relative to the main body, and a button to control a movement of the rear panel relative to the main body. The rear panel includes a first body provided a prescribed height over the main body and a second body that extends from the first body into the main body.

20 Claims, 5 Drawing Sheets

RANGE HAVING AN ADJUSTABLE REAR PANEL

CROSS-REFERENCE TO RELATED APPLICATION(S)

This application claims priority under 35 U.S.C. §119 to Korean Patent Application No. 10-2013-0079455, filed on Jul. 8, 2013, whose entire disclosure is hereby incorporated by reference.

BACKGROUND

1. Field

The present disclosure relates to a range, and more particularly to a range in which the height of a rear panel is adjustable.

2. Background

Ranges having rear panels are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION OF THE DISCLOSURE

Figure 1:
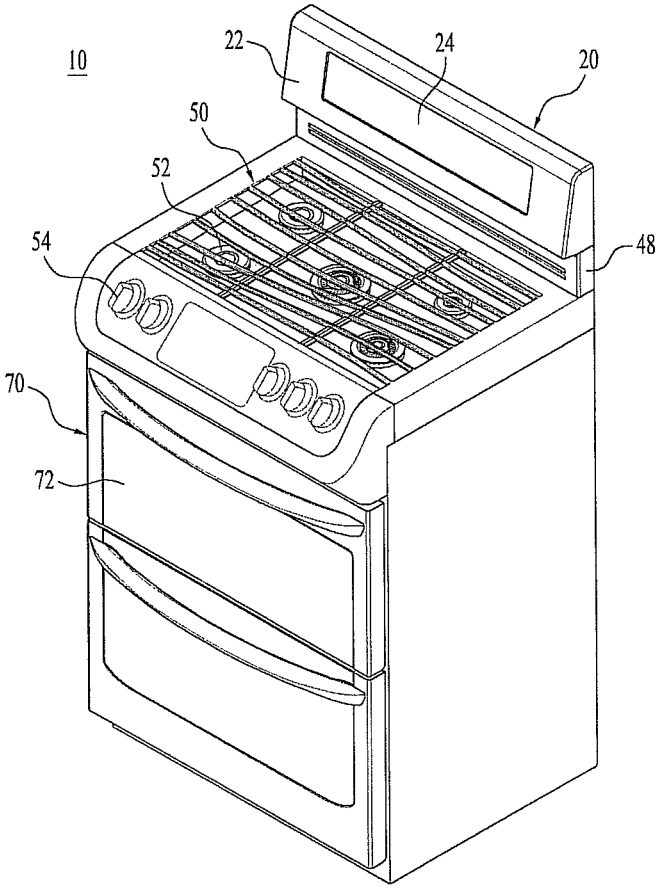
FIG. 1 is a perspective view showing a range according to the present disclosure.

Hereinafter, exemplary embodiments of the present disclosure will be described in detail with reference to the accompanying drawings.

In the following description, sizes, shapes, or the like of constituent elements shown in the drawings may be exaggerated for clarity and convenience of description. In addition, terms particularly defined in consideration the configurations and operations of the present disclosure may be replaced by other terms based on intensions of users and managers, or customs. Definitions of the terms may be based on content of the entire specification.

In general, a range is a kitchen appliance that may include an oven and a cooktop which may be integrated with each other. Ranges are classified into a gas range and an electric range according to a heat source.

In addition, ranges may be classified, according to an installation method thereof, into a built-in type range that is built into kitchen cabinetry so as to be in harmony with other kitchen furniture or walls and a free standing type range that is independently installed at a position that the user desires.

The range generally has a cube shape, and may include burners or heating elements (e.g., cooktop), an oven for cooking items received therein, and a rear panel. The rear panel may be a backguard, backsplash or a downdraft configured to outwardly discharge smoke and gas generated in the oven.

The cooktop may be configured to directly heat items in the container that is placed thereon. To this end, the cooktop may be installed at the top of the range to expose an upper surface thereof. The cooktop may be equipped with a plurality of burners or heating elements. General exposed-type burners that are mounted to be exposed from the upper surface of the cooktop may be used, or enclosed-type burners that are enclosed by ceramic glass may be used.

The oven may be provided below the cooktop. The interior of the oven may define an oven cavity. The space occupied by the oven may comprise the greatest part of the range.

Conventional ranges are configured in such a manner that the rear panel has a fixed position, more particularly, a fixed height relative to the cooktop. The rear panel may be a backguard that includes a display or control panel. Therefore, during use of the cooktop, the display or control on the rear panel may have a risk of contamination due to splattering. In addition, when attempting to use a large container that is either very tall or wide, the container may come into contact with the backsplash, which may make use of large containers difficult. The range as broadly described and embodied herein overcomes these and other disadvantages.

Figure 2:
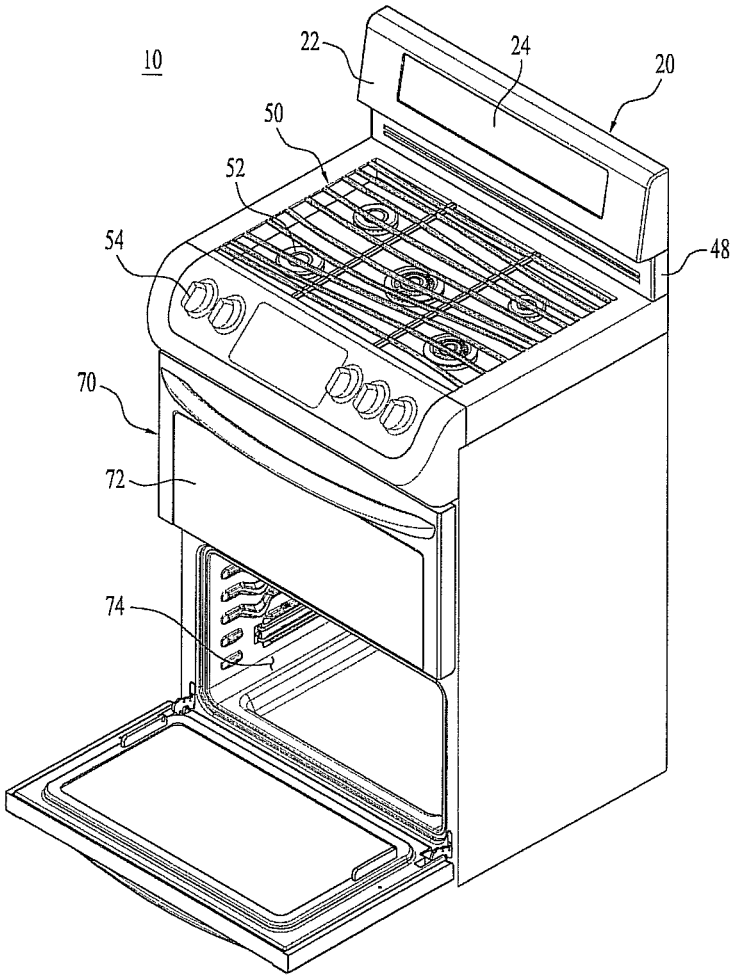
FIG. 2 is a view showing an opened state of an oven door shown in FIG. 1.

FIG. 1 is a perspective view showing a range according to the present disclosure, and FIG. 2 is a view showing an opened state of an oven door shown in FIG. 1. The range may include a main body 10 that may have a cube shape. The range may include an oven 70 provided in the main body 10 for cooking food received in a cavity 74 thereof, a cooktop 50 provided at the upper side of the oven 70 for cooking items placed thereon, and a rear panel 20 (e.g., backguard) provided at the rear side of the cooktop 50 so as to be moved upward or downward relative to the cooktop 50. In this case, the rear panel 20 may be a downdraft and may have a configuration to outwardly discharge smoke and gas generated in the interior of the oven 70, i.e. in the cavity 74.

The cooktop 50 may be configured to directly heat food that is received in a container placed thereon. The cooktop 50 may be mounted at the top of the main body 10 such that an upper surface thereof is exposed. The cooktop 50 may be equipped with a plurality of heaters 52 to heat the container.

A cooktop operating unit 54 (or controls) may be provided at a front surface of the cooktop 50 to control the heaters 52 equipped in the cooktop 50. The cooktop operating unit 54 may be attached to an inclined surface to assist the user in easily accessing the cooktop operating unit 54. Meanwhile, the cooktop operating unit 54 may include a plurality of rotatable levers (or knobs) corresponding to the heaters 52 in a one to one ratio so as to individually operate the plurality of heaters 52.

The oven 70 may be provided below the cooktop 50. In this case, the cavity 74 in which items may be received is defined in the oven 70. The cavity 74 may be sealed or open by an oven door 72. In this case, the oven door 72 may be pivotally coupled to one side of the oven 70, such that a user can open the oven door 72 by pulling the oven door 72 downward.

A separate heater may be provided in the cavity 74. Moreover, a convection fan may be provided in the cavity 74 for convection of air in the cavity 74. That is, the convection fan may circulate the heat from the heater installed in the cavity 74 to the food.

The rear panel 20 may be provided at the rear side of the cooktop 50. The rear panel 20 may serve to outwardly discharge smoke and gas generated while cooking food in the cavity 74. The rear panel 20 may also be a downdraft for smoke or gas from the cooktop 50. The rear panel 20 may also be a backguard. The rear panel 20 may be installed at a position higher than the cooktop 50.

The rear panel 20 may be configured to communicate with one side of the oven 70, i.e. the interior of the cavity 74. The rear panel 20 may include exhaust holes for efficient discharge of smoke and gas generated in the cavity 74.

The rear panel 20 may include a protruding portion 22 (or first body) that is exposed to the user and protrudes toward the front side of the cooktop 50, and an extension portion 48 (or second body) that connects the protruding portion 22 and the main body 10 to each other. In this case, the extension portion 48 may have a thickness that is less than that of the protruding portion 22. The extension portion 48 may be installed so as to be retractable from the main body 10. As such, the height of the protruding portion 22 may be adjusted.

The rear panel 20 may further include a display panel 24 that displays a cooking state of the oven 70. The display panel 24 may provide the user with information regarding cooking time, cooking temperature, etc. with regard to the oven 70. Control of the oven 70 via the display panel 24 may be possible. Moreover, the protruding portion 22 may be tilted by a predetermined gradient to improve access to controls and visibility of the display panel 24.

Figure 3:
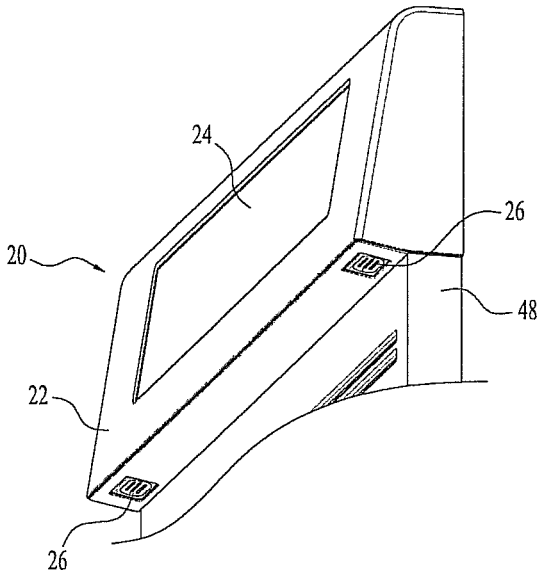
FIG. 3 is a view showing a backguard.

FIG. 3 is a view showing the rear panel. A button 26 that is configured to be pushed by the user may be provided at a lower surface of the protruding portion 22. In this case, providing the button 26 at the lower surface of the protruding portion 22 may prevent the user from unintentionally touching the button 26. That is, it is possible to prevent the height of the rear panel 20 from being inadvertently adjusted due to inadvertent contact by the user or objects on the cooktop 50. In addition, providing the button at the lower surface of the protruding portion 22 may allow the user to support the rear panel 20 while pushing the button 26 at the same time.

In the present embodiment, two buttons 26 may be provided respectively at both ends of the protruding portion 22 to allow the user to push the buttons 26 with both hands. The user may push the buttons 26 upward and at the same time support the backguard 20 while it moves downward relative to the main body 10.

Figure 4:
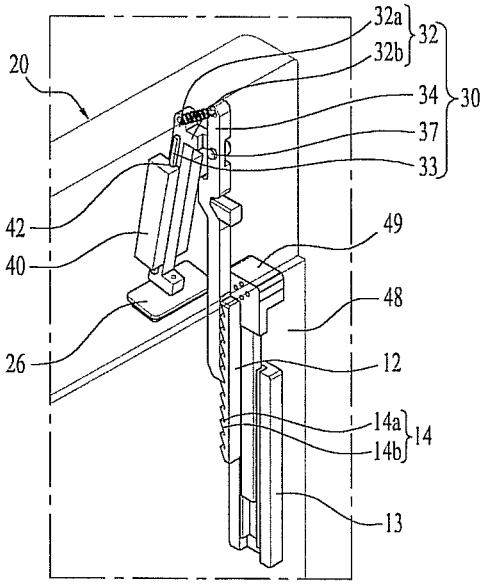
FIG. 4 is a view showing the backguard viewed from the rear side.
Figure 5:
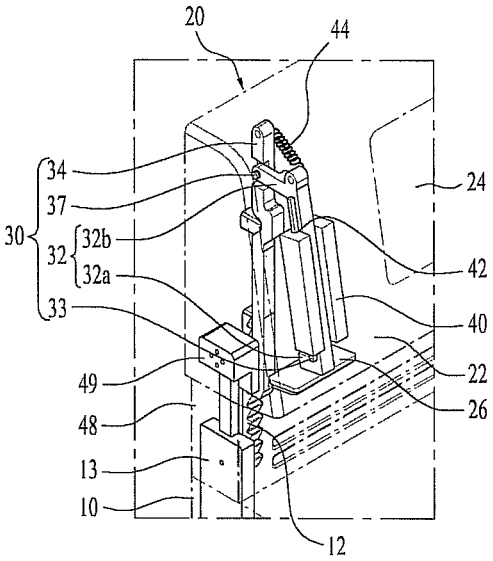
FIG. 5 is a view showing the backguard viewed from the front side.
Figure 6:
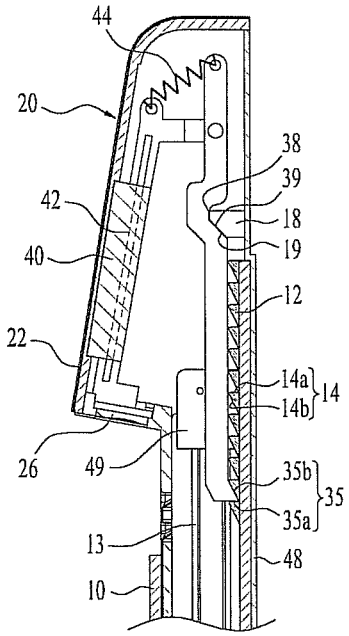
FIG. 6 is a sectional view of the backguard.

FIG. 4 is a rear perspective view of the rear panel, and FIG. 5 is a front perspective view of the rear panel. In addition, FIG. 6 is a sectional view of the rear panel. The rear panel 20 may include a link unit 30 (also referred to herein as a link assembly or linkage) that may be moved via movement of the button 26. The link unit 30 may transfer a displacement of the button 26 when pushed by the user.

The main body 10 may be provided with a rack 12 that may be engaged with the link unit 30 to selectively limit movement of the link unit 30. The rack 12 may allow the link unit 30 to move or restrict movement of the link unit 30 according to a position of the link unit 30.

The link unit 30 may include a first link 32 extending from the button 26 and a second link 34 rotatably connected to the first link 32. The first link 32 and the second link 34 may take the form of bars or shafts having predetermined lengths. Accordingly, the first link 32 may be referred to herein as a first bar and the second link 34 may be referred to herein as a second bar.

The first link 32 may include a first portion 32*a* that extends from the button 26 in a straight direction and a second portion 32*b* (or arm) that extends from the first portion 32*a* at a prescribed angle. The first portion 32*a* may extend linearly from the button 26 so as to transmit displacement of the button 26 in the straight line. The first portion may be a bar, shaft or have another appropriate shape. The second portion 32*b* may extend from the first portion 32*a* at a prescribed angle so as to transmit displacement of the first portion 32*a* at an angle from the first portion 32*a*. The second portion 32*b* may be a bar, a shaft, a protrusion or have another appropriate shape to extend to the second link 34.

The rear panel 20 may further include a guide 40 to guide linear movement of the link unit 30, e.g., movement of the first link 32 as the button 26 is pushed. The guide 40 may be located in an interior space of the protruding portion 22. The guide 40 may be located to surround both lateral surfaces of the first link 32.

The guide 40 may have a longitudinal guide groove 42, and the first link 32 may include a guide protrusion 33 movably inserted into the guide groove 42. The guide groove 42 and the guide protrusion 33 may be formed to extend linearly such that the first link 32 is movable in a straight direction relative to the guide 40.

The first link 32 and the second link 34 may be connected to each other via a rotating shaft 37 (or pin). The rotating shaft 37 may be movably placed in the interior space of the rear panel 20 rather than being fixed to other inner components of the rear panel 20. Accordingly, movement of the first link 32 may be transmitted to the second link 34 via the rotating shaft 37 without interference.

The second link 34 may include a holding recess 38 (or notch) indented in a lateral surface thereof. The holding recess 38 may be formed on a surface of the second link 34 that faces the rear side of the main body 10. That is, the holding recess 38 may be formed on a surface that does not face the first link 32 and may serve to guide movement of the second link 34.

The main body 10 may be provided with a holding piece 18 to be caught by the holding recess 38 so as to selectively fix the second link 34. The holding piece 18 may be a protrusion having a prescribed shape. The holding piece 18 may be positioned in the holding recess 38 when the button 26 is not depressed. As such, the holding piece 18 may be positioned to fix the second link 34.

The holding piece 18 and corresponding holding recess 38 may have prescribed shapes that correspond to each other. The holding piece 18 may include a first slope 39 (or first inclined surface) that is tilted rearward relative to the main body 10, and the holding recess 38 may include a second slope 19 (or second inclined surface) facing the first slope 39. The holding recess 38 may have a shape corresponding to that of the holding piece 18 for insertion and fixing of the holding piece 18.

The rack 12 may have a plurality of teeth 14, and each tooth 14 may include a horizontal first face 14*a* (or lateral surface) and an inclined second face 14*b* (an inclined surface) that is downwardly tapered from one end of the lateral surface 14*a*. The lateral surface 14*a* and the inclined surface 14*b* may be adjacent to each other such that each tooth 14 may generally have a right triangular shape.

The second link 34 may be engaged with the teeth 14 to restrict movement of the rear panel 20. The second link 34 may include a protrusion 35 that has a horizontal first face 35*a* (or lateral surface) and an inclined second face 35*b* (or inclined surface) that obliquely extends from one end of the first face 35*a*. The first and second face 35*a*, 35*b* may be referred to herein as a lateral surface or face and an inclined surface or face, respectively. Moreover, the protrusion 35 may be provided at a distal bottom end of the second link 34. When the lateral surface 14*a* of a tooth 14 comes into contact with the lateral surface 35*a* of the second link 34, the rear panel 20 may be kept at a fixed height and downward movement may be restricted.

The first link 32 and the second link 34 may be fixed to an elastic member 44 that elastically supports the first link 32 and the second link 34 with a predetermined distance therebetween. In this case, the elastic member 34 may secure the first link 32 to one end of the second link 34, thereby providing a force to laterally push the other end of the second link 34, i.e. the protrusion 35 toward a tooth 14 on the rack 12.

The rear panel 20 may be provided with a first rail 49 to guide movement of the rear panel 20 relative to the main body 10, and the main body 10 may be provided with a second rail 13 movably coupled to the first rail 49. The first rail 49 may be surrounded by the second rail 13 so as to move linearly relative to the second rail 13.

Meanwhile, the constituent elements exemplarily shown in FIGS. 4 to 6 may be arranged respectively at both lateral sides of the rear panel 20 and the main body 10. As such, movement of the rear panel 20 may be guided such that both ends of the rear panel 20 maintain level relative to the main body 10.

Figure 7:
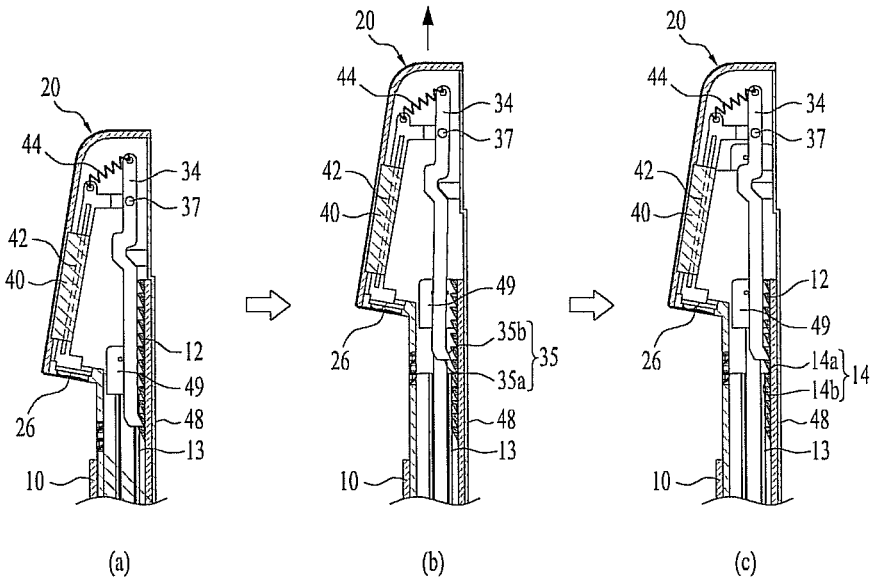
FIG. 7 is a sectional view illustrating an upward movement of the backguard.

FIG. 7 is a sectional view that illustrates an upward movement of the rear panel. When attempting to move the rear panel 20 upward relative to the main body 10, the user does not need to push the button 26. In a state as exemplarily shown in FIG. 7(*a*), the user may move the rear panel 20 upwards relative to the main body 10 after gripping the rear panel 20.

If the user moves the rear panel 20 upward, as exemplarily illustrated in FIG. 7(*b*), the inclined surface 35*b* of the protrusion 35 slides against the inclined surface 14*b* of the teeth 14 to thereby disengage the second link 34 and allow upward movement of the rear panel 20. In this case, the second link 34 may move along with the rear panel 20, and therefore upward movement force is applied to the second link 34. As the second link 34 is moved upward, the inclined surface 35*b* may repeatedly come into contact with or be released from each successive inclined surface 14*b* of successive teeth 14.

Once the rear panel 20 is raised to a desired height, as exemplarily illustrated in FIG. 7(*c*), the lateral surface 35*a* and the lateral surface 14*a* of a corresponding tooth 14 come into contact with each other such that the lateral surface 14*a* supports the lateral surface 35*a* to stop downward movement of the second link 34. That is, a height of the rear panel 20 may be fixed at a desired height. In this case, since the second link 34 is moved together with the rear panel 20 and holding protrusion 18, relative positions of the holding recess 38 and the holding protrusion 18 remain the same. When the button 26 is released, the holding protrusion 18 seats inside the holding recess 38 allowing the second link 34 to engage the rack 20.

The protruding portion 22 of the rear panel 20 may have a thickness greater than that of the extension portion 48. As such, in the case in which a container having a large width or height is placed on the cooktop 50, the protruding portion 22 may come into contact with the container or otherwise construct view of the display panel 24, inconveniencing the user. In this case, the user may raise the protruding portion 22 higher and away from the container. Moreover, in raising the rear panel 20, display of the display panel 24 and access to controls may be improved.

Figure 8:
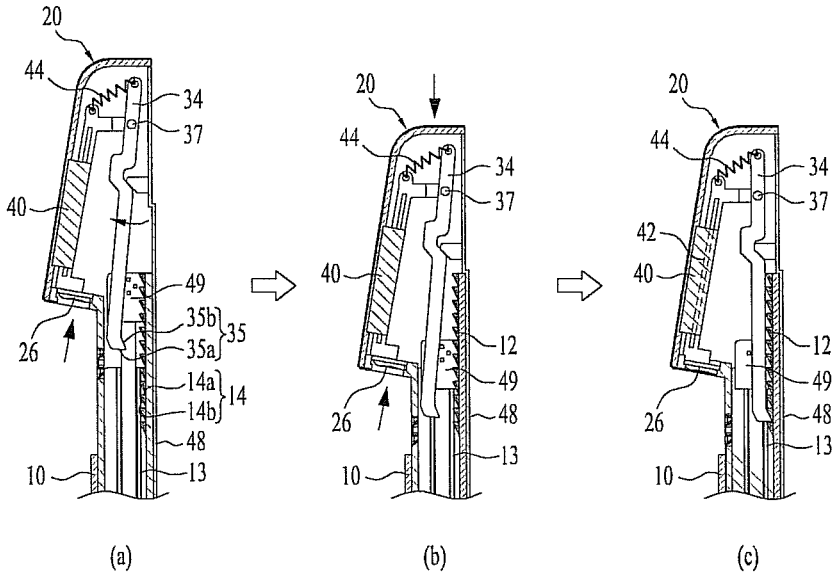
FIG. 8 is a sectional view illustrating a downward movement of the backguard.

FIG. 8 is a sectional view illustrating a downward movement of the rear panel. The user may push the button 26 to downwardly move the rear panel 20 as exemplarily shown in FIG. 8(*a*). In this case, the user may depress the two buttons 26 such that both ends of the rear panel 20 may be moved downwardly.

When the button 26 is pushed, the first link 32 is moved upward and a position of the second link 34 is changed, i.e., raised. Since the first link 32 and the second link 34 are coupled to each other via the rotating shaft 37, displacement of the first link 32 may be transmitted to the second link 34.

In this case, the first inclined surface 39 of the holding recess 38 slides on the second inclined surface 19 of the holding protrusion 18 and a contact area between the first inclined surface 39 and the second inclined surface 19 is reduced. Thereby, the second link 34 is displaced laterally away from the rack 12 and a position of the second link 34 relative to the rack 12 may be changed. That is, the second link 34 pivots about arm 32*b* of the first link 32 such that the lower end of the second link 34 moves away from the rack 12.

Hence, the protrusion 35, which may be provided at a distal bottom end of the second link 34, may be displaced laterally due to the lateral movement of the second link 34. Hence, the protrusion 35 may be moved away from a rear surface of the rear panel 20. In this case, since the second link 34 comes into contact with the holding piece 18, the second link 34 may exert sufficient force to overcome elastic support force of the elastic member 44.

Accordingly, the protrusion 35 may release from the teeth 14, and the second link 34 may be moved downward without interference by the rack 12. The rear panel 20 may then be freely moved downward to a desired height as illustrated in FIG. 8(*b*).

Once the rear panel 20 is moved down to a desired position, as exemplarily illustrated in FIG. 8(*c*), pressure applied to the button 26 may be removed. Thereby, the first link 32 is moved downward along a guidance path of the guide 40, and the force applied to the second link 34 may be removed. As the second link 34 is also moved downward, the holding protrusion 18 is again inserted into the holding recess 38 of the second link 34, and a position of the second link 34 may be fixed.

Then, the lateral surface 35*a* of the locking protrusion 35 and the lateral surface 14*a* of a corresponding tooth 14 may come into contact with each other to prevent vertical movement of the second link 34. Accordingly, the rear panel 20 may be locked into position and can no longer be moved downward.

As broadly described and embodied herein, a range is provided herein in which, through adjustment in the height of a rear panel, the cooktop may accommodate a container having a large height or width. In addition, even when such containers are used, the user may easily view a display panel or access the controls provided on the rear panel.

In accordance with one aspect of the present disclosure, a range may include a main body, an oven provided in the main body, a cooktop provided over the oven, a rear panel provided over the main body adjacent the cooktop and configured to slidably extend relative to the main body and a button to control a movement of the rear panel relative to the main body. The button may be provided on the rear panel which may include a first body provided at a prescribed height over the main body and a second body that extends from the first body into the main body. The first body may have a lower surface that protrudes from the second body and the button may be provided on the lower surface of the first body.

The rear panel may also include a linkage attached to the button and configured to restrict vertical movement of the rear panel relative to the main body which may include a rack that extends vertically and configured to engage with the linkage.

The linkage may include a first bar that extends upward from the button and a second bar that extends downward from an upper portion of the first bar where the second bar is provided adjacent the rack to engage with the rack. The second bar may be coupled to the main body such that a vertical movement of the second bar disengages the second bar from the rack. The second bar may include a recess and the first body of the rear panel may include a protrusion provided to correspond to the recess where the recess has a first inclined surface and the protrusion has a second inclined surface, and the first and second inclined surfaces are configured to slide against each other to laterally displace the second bar away from the rail in response to a vertical movement of the second bar.

The first bar may include an arm at the upper portion of the first bar that extends at a prescribed angle from the first bar and pivotably coupled to the second bar where the second bar is configured to pivot about the arm to engage or disengage with the rack. The second bar may be configured to disengage with the rack in response to a vertical movement of the button.

The second bar may include a protrusion and the rack includes a plurality of teeth configured to engage with the protrusion on the second bar to restrict downward movement of the rear panel and to disengage to allow upward movement of the rear panel. The teeth on the rack may include a lateral surface and an inclined surface that tapers down from a distal end of the lateral surface, and the protrusion on the second bar may include a lateral surface and an inclined surface that correspond to the lateral and inclined surfaces of the teeth on the rack.

The rear panel may include a guide rail configured to guide movement of the linkage relative to the rear panel when the button is depressed. The linkage may include a guide protrusion configured to slidably couple to the guide rail of the rear panel. The first body of the rear panel may have a thickness less than a thickness of the second body, the first body being movably coupled to the main body to be pushed into or pulled out from the main body.

The cooktop may include at least one control provided at a front surface of the cooktop to control a heater equipped in the cooktop. The rear panel may be a backguard that includes a display configured to display a state of the oven. The rear panel may include a first rail and the main body may include a second rail configured to couple to the first rail to guide a vertical movement of the rear panel relative to the cooktop.

In another embodiment, a kitchen appliance may include a main body having an opening provided on an upper surface of the main body, an oven provided in the main body, a cooktop provided over the oven, which cooktop may include controls for controlling the cooktop at a front surface of the cooktop, and a backguard provided toward a rear side of the cooktop, a height of the backguard being adjustable relative to the cooktop. The backguard may include a first body provided through the opening and movably coupled to the main body, the first body having a prescribed shape that corresponds to a shape of the opening and a second body provided over the first body, the second body having a thickness greater than a thickness of the first body to protrude toward a front of the main body. The first body may be configured to be pushed into our pulled out from the main body to adjust a height of the second body relative to the cooktop.

In one embodiment, a range may include an oven provided in a main body for cooking of a cooking material received in a cavity thereof, a cooktop provided at the upper side of the oven for cooking of a cooking material placed thereon, and a rear panel provided at the rear side of the cooktop so as to be moved upward or downward relative to the cooktop, wherein the rear panel includes a protruding portion that is exposed to a user and protrudes toward the front side of the cooktop, and wherein the protruding portion is provided with a button configured to be pushed by the user, and the rear panel is movable downward relative to the main body if the button is pushed. The button may be installed at a lower surface of the protruding portion.

The rear panel may include a link unit configured to be moved via movement of the button. The main body may include a rack configured to be engaged with the link unit so as to selectively limit movement of the link unit. The rack may include a plurality of teeth, and each tooth may include a horizontal first piece, and a second piece that is downwardly tapered from one end of the first piece.

The rear panel may further include a guide configured to guide straight movement of the link unit as the button is pushed. The link unit may include a guide protrusion extending in a straight direction, and the guide may include a guide groove into which the guide protrusion is movably inserted.

The link unit may include a first link extending from the button, and a second link rotatably connected to the first link. The link unit may include a rotating shaft configured to connect the first link and the second link to each other, and the rotating shaft may be movable along the first link. The second link may include a holding recess indented therein, and the rear panel may include a holding piece configured to be caught by the holding recess so as to selectively fix the second link.

The holding piece may include a first slope configured to be tilted rearward of the main body, and the holding recess may include a second slope located to face the first slope. The second slope may be moved such that a contact area between the first slope and the second slope is reduced if the button is pushed. The link unit may further include an elastic member configured to elastically support the first link and the second link so as to maintain a predetermined distance therebetween.

The second link may include a first face that extends horizontally so as to be engaged with the rack, and a second face that obliquely extends from one end of the first face. The link unit may be moved upward or downward relative to the main body along with the rear panel.

The rear panel may further include extension portion having a less thickness than that of the protruding portion, the extension portion being coupled to the main body so as to be pushed into or pulled from the main body. The cooktop may include a cooktop operating unit provided at a front surface thereof to control a heater equipped in the cooktop. The rear panel may further include a display panel configured to display a cooking state of the oven. Moreover, the rear panel may be provided with a first rail, and the main body may be provided with a second rail configured to guide vertical movement of the first rail.

In one embodiment, a range may include an oven provided in a main body for cooking of a cooking material received in a cavity thereof, a cooktop provided at the upper side of the oven for cooking of a cooking material placed thereon, and a rear panel provided at the rear side of the cooktop so as to be moved upward or downward relative to the cooktop, wherein the rear panel includes a protruding portion that is exposed to a user and protrudes toward the front side of the cooktop, and extension portion having a less thickness than that of the protruding portion, the extension portion being coupled to the main body so as to be pushed into or pulled from the main body, and wherein the cooktop includes a cooktop operating unit provided at a front surface thereof to control a heater equipped in the cooktop.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A range comprising:

a main body;

an oven provided in the main body;

a cooktop provided over the oven; and a rear panel provided over the main body adjacent the cooktop and configured to slidably extend relative to the main body, wherein the rear panel includes a second body installed to be retractable from the main body;

a first body protruding from the second body toward a front direction and provided a prescribed height over the main body, wherein a thickness of the first body is more than a thickness of the second body; and a button provided on a lower surface of the first body to be pressed upward to control a movement of the rear panel relative to the main body.

2. The range of claim 1, wherein the rear panel includes a linkage attached to the button and configured to restrict vertical movement of the rear panel relative to the main body.

3. The range of claim 2, wherein the main body includes a rack that extends vertically and configured to engage with the linkage.

4. The range of claim 3, wherein the rear panel is configured to extend out from the main body in response to a vertical force applied to the rear panel and to retract into the main body in response to a displacement of the button.

5. The range of claim 4, wherein the rear panel includes a guide rail configured to guide movement of the linkage relative to the rear panel when the button is depressed.

6. The range of claim 5, wherein the linkage includes a guide protrusion configured to slidably couple to the guide rail of the rear panel.

7. The range of claim 3, wherein the linkage includes a first bar that extends upward from the button and a second bar that extends downward from an upper portion of the first bar, the second bar being provided adjacent the rack to engage with the rack.

8. The range of claim 7, wherein the second bar is configured to disengage with the rack in response to a vertical movement of the button.

9. The range of claim 7, wherein the second bar includes a protrusion and the rack includes a plurality of teeth configured to engage with the protrusion on the second bar to restrict downward movement of the rear panel and to disengage to allow upward movement of the rear panel.

10. The range of claim 9, wherein the teeth on the rack include a lateral surface and an inclined surface that tapers down from a distal end of the lateral surface, and wherein the protrusion on the second bar includes a lateral surface and an inclined surface that correspond to the lateral and inclined surfaces of the teeth on the rack.

11. The range of claim 7, wherein the second bar is coupled to the main body such that a vertical movement of the second bar disengages the second bar from the rack.

12. The range of claim 11, wherein the second bar includes a recess and the first body of the rear panel includes a protrusion provided to correspond to the recess, the recess having a first inclined surface and the protrusion having a second inclined surface, the first and second inclined surfaces configured to slide against each other to laterally displace the second bar away from the rail in response to a vertical movement of the second bar.

13. The range of claim 12, wherein the first bar includes an arm at the upper portion of the first bar that extends at a prescribed angle from the first bar and pivotably coupled to the second bar, the second bar being configured to pivot about the arm to engage or disengage with the rack.

14. The range according to claim 1, wherein the second body being movably coupled to the main body to be pushed into or pulled out from the main body.

15. The range according to claim 1, wherein the cooktop includes at least one control provided at a front surface of the cooktop to control a heater equipped in the cooktop.

16. The range according to claim 1, wherein the rear panel is a backguard that includes a display configured to display a state of the oven.

17. The range according to claim 1, wherein the rear panel includes a first rail and the main body includes a second rail configured to couple to the first rail to guide a vertical movement of the rear panel relative to the cooktop.

18. A kitchen appliance comprising:

a main body having an opening provided on an upper surface of the main body;

an oven provided in the main body;

a cooktop provided over the oven, the cooktop including controls for controlling the cooktop at a front surface of the cooktop; and a backguard provided toward a rear side of the cooktop, a height of the backguard being adjustable relative to the cooktop, wherein the backguard includes a second body provided through the opening and movably coupled to the main body, the second body having a prescribed shape that corresponds to a shape of the opening, a first body provided over the second body, the first body having a thickness greater than a thickness of the second body to protrude toward a front of the main body, and a button provided on a lower surface of the first body to be pressed upward to control a movement of the rear panel relative to the main body, wherein the second body is configured to be pushed into or pulled out from the main body to adjust a height of the first body relative to the cooktop.

19. A range comprising:

a main body;

an oven provided in the main body;

a cooktop provided over the oven; and a rear panel provided over the main body adjacent the cooktop and configured to slidably extend relative to the main body, wherein the rear panel includes a second body installed to be retractable from the main body;

a first body protruding from the second body toward a front direction and provided a prescribed height over the main body, wherein a thickness of the first body is more than a thickness of the second body; and a button provided on a lower surface of the first body to be pressed upward to control a movement of the rear panel relative to the main body, wherein the rear panel is configured to extend out from the main body in response to a vertical force applied to the rear panel and to retract into the main body in response to a displacement of the button.

20. A kitchen appliance comprising:

a main body having an opening provided on an upper surface of the main body;

an oven provided in the main body;

a cooktop provided over the oven, the cooktop including controls for controlling the cooktop at a front surface of the cooktop; and a backguard provided toward a rear side of the cooktop, a height of the backguard being adjustable relative to the cooktop, wherein the backguard includes a second body provided through the opening and movably coupled to the main body, the second body having a prescribed shape that corresponds to a shape of the opening, a first body provided over the second body, the first body having a thickness greater than a thickness of the second body to protrude toward a front of the main body, and a button provided on a lower surface of the first body to be pressed upward to control a movement of the rear panel relative to the main body, wherein the second body is configured to be pushed into or pulled out from the main body to adjust a height of the first body relative to the cooktop, wherein the backguard is configured to extend out from the main body in response to a vertical force applied to the backguard and to retract into the main body in response to a displacement of the button.

* * * * *